US011684542B2

(12) United States Patent
Paradis

(10) Patent No.: US 11,684,542 B2
(45) Date of Patent: Jun. 27, 2023

(54) METHOD TO INCREASE THE EFFICACY OF CARDIOPULMONARY RESUSCITATION BY MEANS OF ALTERNATING PHASES DURING WHICH THE PHYSICAL CHARACTERISTICS OF CHEST COMPRESSION ARE VARIED SO AS TO INCREASE OVERALL FORWARD BLOOD FLOW

(71) Applicant: Norman A. Paradis, Putney, VT (US)

(72) Inventor: Norman A. Paradis, Putney, VT (US)

( * ) Notice: Subject to any disclaimer, the term of this patent is extended or adjusted under 35 U.S.C. 154(b) by 808 days.

(21) Appl. No.: 15/657,078

(22) Filed: Jul. 21, 2017

(65) Prior Publication Data

US 2018/0021216 A1 Jan. 25, 2018

Related U.S. Application Data

(60) Provisional application No. 62/365,461, filed on Jul. 22, 2016.

(51) Int. Cl.
*A61H 31/00* (2006.01)

(52) U.S. Cl.
CPC ..... *A61H 31/006* (2013.01); *A61H 31/008* (2013.01); *A61H 2230/045* (2013.01); *A61H 2230/08* (2013.01)

(58) Field of Classification Search
CPC ..... A61H 31/006; A61H 31/008; A61H 2230/045; A61H 2230/08; A61H 31/004; A61H 31/005; A61H 2201/5005
See application file for complete search history.

(56) References Cited

U.S. PATENT DOCUMENTS

| | | | |
|---|---|---|---|
| 2,699,163 | A | 1/1955 | Carl-Gunnar |
| 2,899,955 | A | 8/1959 | Huxley |
| 3,364,924 | A | 1/1968 | Barkalow |
| 3,481,327 | A | 12/1969 | Drennen |
| 3,683,655 | A | 8/1972 | White |

(Continued)

FOREIGN PATENT DOCUMENTS

| | | | |
|---|---|---|---|
| EP | 2709581 | B1 | 3/2014 |
| KR | 101383051 | B1 | 4/2014 |

(Continued)

OTHER PUBLICATIONS

Callaway, Clifton W.; Why We Should No Longer Terminate Resuscitations after 20 Minutes; Mar. 2, 2016; Journal of Emergency Medical Services; vol. 41, Issue 3; (Year: 2016).*

(Continued)

*Primary Examiner* — Valerie L Woodward
*Assistant Examiner* — Paige Kathleen Bugg
(74) *Attorney, Agent, or Firm* — Nathaniel A. Wickliffe

(57) ABSTRACT

A method to increase the overall hemodynamic efficacy of cardiopulmonary resuscitation (CPR) by alternating between chest compression-decompression cycles optimized to either cardiac output or venous return. The phases of cardiac output and venous return enhancement may themselves by adjusted in their duration and character. The method may enhance mechanical and manual techniques delivered to the anterior or circumferential chest, and be synchronized to adjunctive techniques such as airway, ventilatory or abdominal therapies.

15 Claims, 7 Drawing Sheets

(56) References Cited

U.S. PATENT DOCUMENTS

| | | | | |
|---|---|---|---|---|
| 4,198,963 | A | 4/1980 | Barkalow | |
| 4,349,015 | A | 9/1982 | Alferness | |
| 4,397,306 | A | 8/1983 | Weisfeldt | |
| 4,424,806 | A | 1/1984 | Newman | |
| 4,664,098 | A | 5/1987 | Woudenberg | |
| 4,770,164 | A | 9/1988 | Lach | |
| 4,838,263 | A | 6/1989 | Warwick | |
| 4,840,167 | A | 6/1989 | Olsson | |
| 4,928,674 | A | 5/1990 | Halperin | |
| 5,076,259 | A | 12/1991 | Hayek | |
| 5,222,478 | A | 6/1993 | Scarberry | |
| 5,454,779 | A | 10/1995 | Lurie | |
| 5,490,820 | A | 2/1996 | Schock | |
| 5,496,257 | A | 3/1996 | Kelly | |
| 5,743,864 | A | 4/1998 | Baldwin | |
| 5,769,800 | A | 6/1998 | Gelfand | |
| 6,171,267 | B1 | 1/2001 | Baldwin | |
| 6,174,295 | B1 | 1/2001 | Cantrell | |
| 6,224,562 | B1 | 5/2001 | Lurie | |
| 6,390,996 | B1 | 5/2002 | Halperin | |
| 6,393,316 | B1 | 5/2002 | Gillberg | |
| 6,418,342 | B1 | 7/2002 | Owen | |
| 6,427,685 | B1 | 8/2002 | Ray | |
| 6,752,771 | B2 | 6/2004 | Rothman | |
| 6,827,695 | B2 | 12/2004 | Palazzolo | |
| 6,869,409 | B2 | 3/2005 | Rothman | |
| 7,032,596 | B2 | 4/2006 | Thompson | |
| 7,220,235 | B2 | 5/2007 | Gehab | |
| 8,795,208 | B2 * | 8/2014 | Walker | A61H 31/004 601/41 |
| 10,245,209 | B2 | 4/2019 | Lurie | |
| 2001/0007928 | A1 | 7/2001 | Hansen | |
| 2002/0026131 | A1 | 2/2002 | Halperin | |
| 2003/0004445 | A1 | 1/2003 | Hall | |
| 2004/0230140 | A1 | 11/2004 | Steen | |
| 2006/0089574 | A1 * | 4/2006 | Paradis | A61H 31/005 601/41 |
| 2007/0010765 | A1 | 1/2007 | Rothman | |
| 2007/0032829 | A1 | 2/2007 | Ostroff | |
| 2007/0060785 | A1 | 3/2007 | Freeman | |
| 2007/0225623 | A1 * | 9/2007 | Freeman | A61M 16/1075 601/44 |
| 2008/0097534 | A1 | 4/2008 | Myklebust | |
| 2008/0275371 | A1 | 11/2008 | Hoffmann | |
| 2012/0016179 | A1 | 1/2012 | Paradis | |
| 2014/0155792 | A1 * | 6/2014 | Karve | A61H 31/008 601/41 |
| 2014/0213942 | A1 | 7/2014 | Hanson | |
| 2014/0336546 | A1 * | 11/2014 | Chapman | A61H 31/005 601/41 |
| 2014/0358047 | A1 | 12/2014 | Lurie | |
| 2015/0265497 | A1 * | 9/2015 | Kaufman | A61H 31/006 601/41 |
| 2016/0361228 | A1 | 12/2016 | Paradis | |
| 2017/0035650 | A1 * | 2/2017 | Taylor | G16H 20/30 |
| 2017/0266078 | A1 | 9/2017 | Jayne | |
| 2019/0209428 | A1 | 7/2019 | Paradis | |

FOREIGN PATENT DOCUMENTS

| | | | |
|---|---|---|---|
| KR | 20160146462 | A | 12/2016 |
| WO | 2010099628 | A1 | 9/2010 |
| WO | 2014051934 | A1 | 4/2014 |
| WO | 2015048347 | A1 | 4/2015 |

OTHER PUBLICATIONS

McClung, Christian D., et al.; Interposed Abdominal Compression CPR for an Out-of-Hospital Cardiac Arrest Victim Failing Traditional CPR; Oct. 20, 2015; Western Journal of Emergency Medicine; vol. XVI, No. 5; 690-692 (Year: 2015).*

Vector Definition; 2020; Merriam-Webster; https://www.merriam-webster.com/dictionary/vector (Year: 2020).*

Bircher, N., et al., Do Intrathoracic Pressure Fluctuation or Heart Compressions Move Blood During External Cardiopulmonary Resuscitation (CPR)?, Resuscitation Research Center and the Department of Anesthesiology, university of Pittsburgh, ASA Abstract, V53, No. 3, Sep. 1980.

Cohen, Todd J., et al., Active Compression-Decompression, A New Method of Cardiopulmonary Resuscitation, JAMA, Jun. 3, 1992, vol. 267, No. 21, pp. 2916-2923.

Cohen, Todd J., et al, Active Compression-Decompression Resuscitation: A Novel Method of Cardiopulmonary Resuscitation, American Heart Journal, Nov. 1992, pp. 1145-1150.

Halperin, M.D., Henry R., A Preliminary Study of Cardiopulmonary Resuscitation by Circumferential Compression of the Chest with use of a Pneumatic Vest, The New England Journal of Medicine, vol. 329 No. 11, Sep. 9, 1993, pp. 762-768.

Kouwenhoven, W.B., Closed-Chest Cardiac Massage, JAMA, Jul. 9, 1960, vol. 173, No. 10, pp. 1064-1067.

McDonald, M.D., John L, Systolic and Mean Arterial Pressures During Manual and Mechanical CPR in Humans, Annals of Emergency Medicine, 11:6 Une 1982, pp. 292-295.

Ralston, Sandra H., Cardiopulmonary Resuscitation with Interposed Abdominal Compression in Dogs, Anesthesia and Analgesia, vol. 61, No. 8, Aug. 1982, pp. 645-651.

Voorhees, PhD, William D. et al, Improved Oxygen Delivery During Cardiopulmonary Resuscitation with Interposed Abdominal Compressions, Annals of Emergency Medicine, 12:Mar. 3, 1983, pp. 128-135.

Wolcke, MD., Benno G., et al, Comparison of Standard Cardiopulmonary Resuscitation Versus the Combination of Active Compression-Decompression Cardiopulmonary Resuscitation and an Inspiratory Impedance Threshold Device for Out-of-Hospital Cardiac Arrest, Circulation, 2003, pp. 108, 2201-2205.

Abella, Benjamin S. et al, CPR quality improvement during in-hospital cardiac arrest using a real-time audiovisual feedback system, Resuscitation, 2007, 73, pp. 54-61.

Babbs, MD, Charles F., Preclinical Studies of Abdominal Counterpulsation in CPR, Annals of Emergency Medicine, 13:Sep. 9, 1984, pp. 761-763.

Berkowiiz, Ivor D., et al, Blood Flow during Cardiopulmonary Resuscitation with Simultaneous Compression and Ventilation in Infant Pigs, Pediatric Research, 1989, vol. 26, No. 6, pp. 558-564.

Haas, Thorsten, et al, Revisiting the cardiac versus thoracic pump mechanism during cardiopulmonary resuscitation, Resuscitation, 58, Nov. 5, 2002, pp. 113-116.

Jenkins, Constance, et al, Effects of the ResQPOD on Kinetics, Hemodynamics of Vasopressin, and Survivability in a Porcine Cardiac Arrest Model, Military Medicine, vol. 180, Sep. 2015, pp. 1011-1016.

Kleinman, Monica E., et al, Part 5: Adult Basic Life Support and Cardiopulmonary Resuscitation Quality: 2015 American Heart Association Guidelines Update for Cardiopulmonary Resuscitation, and Emergency Cardiovascular Care, Circulation, 2015, 132, S414-S435.

Michael, John R., et al, Mechanisms by with epinephrine augments cerebral and myocardial perfusion during cardiopulmonary resuscitation in dogs, Circulation 69, No. 4, 822-834, 1984.

Niemann MD., James T., Cough-CPR, Documentation of systemic perfusion in man and in an experimental model: a "window" to the mechanism of blood flow in external CPR, Critical Care Medicine, vol. 8, No. 3, pp. 141-146, Mar. 1980.

Paradis M.D., Norman A., Simultaneous Aortic, Jugular Bulb, and Right Atrial Pressures During Cardiopulmonary Resuscitation in Humans, Insights Into Mechanisms, Circulation, vol. 80, No. 2, Aug. 1989.

Plaisance, M.D., Patrick, A Comparison of Standard Cardiopulmonary Resuscitation and Active Compression-Decompression Resuscitation for Out-of-Hospital Cardiac Arrest, New England Journal of Medicine, vol. 341, No. 8, Aug. 19, 1999, pp. 569-575.

Segal, M.D., PhD, Nicolas, Intermittent Positive-Pressure Ventilation, Chest Compression Synchronized Ventilation, Bilevel Ventilation, Continuous Chest Compression, Active Compression Decompression, and Impedance Threshold Device—The Complexity of

(56) References Cited

OTHER PUBLICATIONS

Ventilation During Cardiopulmonary Resuscitation, Critical Care Medicine, Feb. 2014, vol. 42, No. 2, pp. 480-481.
Wang, M.D., Chih-Hung, et al, Active Compression-Decompression Resuscitation and Impedance Threshold Device for Out-of-Hospital Cardiac Arrest: A Systematic Review and Metaanalysis of Randomized Controlled Trials, Critical Dare Medicine, Apr. 2015, vol. 43, No. 4, pp. 889-896.
Weisfeldt, M.D., M.L., et al, Increased intrathoracic pressure-No. direct heart compression-causes the rise in intrathoracic vascular pressures during CPR in dogs and pigs, Critical Care Medicine, p. 377-378, May 1981.
Yeung, J., et al, The use of CPR feedback/prompt devices during training and CPR performance: A systematic review, Resuscitation, 80, pp. 743-751, 2009.
Yang, Z., et al. A tourniquet assisted cardiopulmonary resuscitation augments myocardial perfusion in a porcine model of cardiac arrest, Resuscitation 86 (2015) 49-53.
Plaisance et al., "Evaluation of an impedance threshold device in patients receiving active compression-decompression cardiopulmonary resuscitation for out of hospital cardiac arrest", Elsevier, Resuscitation 61 (2004) 265-271, www.elsevier.com/locate/resuscitation.
Liao et al., "Manual versus mechanical cardiopulmonary resuscitation. An experimental study in pigs", BMC Cardiovascular Disorders, Oct. 2010, 10:53, http://www.biomedcentral.com/1471-2261/10/53 (8 pages).
Lurie et a., "Improving active compression-decompression resuscitation with an inspiratory impedance valve", originally published Mar. 15, 1995, https://doi.org/10.1161/01.CIR.91.6.1629, Circulation. 1995; 91:1629-1632.
Lurie et al., "Improving standard cardiopulmonary resuscitation with an inspiratory impedance threshold valve in a porcine model of cardiac arrest", Anesth Analg 2001; 93:649-655.
Lafuente-Lafuente et al., "Active chest compression-decompression for cardiopulmonary resuscitation (Review)," The Cochrane Collaboration, 2009, Issue 3 (40 pages).
Aiello et al., "Real-time ventricular fibrillation amplitude-spectral area analysis to guide timing of shock delivery improves defibrillation efficacy during cardiopulmonary resuscitation in swine", Journal of the American Heart Association, DOI: 10.1161/JAHA.117.006749, pp. 1-15.
Aufderheide, T. P., et al. "Clinical evaluation of an inspiratory impedance threshold device during standard cardiopulmonary resuscitation in patients with out-of-hospital cardiac arrest." Crit Care Med. 33.4 (2005): 734-40.
Barkalow, B. H. "Comparison of miniaturized pneumatic chest compressor to Thumper." Resuscitation 79.3 (2008): 509.
Paradis, Norman A., et al, Cardiac Arrest, The Science and Practice of Resuscitation Medicine, 2nd edition, Cambridge University Press 2007.
Cave DM, Gazmuri RJ, Otto CW et al. "Part 7: CPR techniques and devices: 2010 American Heart Association Guidelines for Cardiopulmonary Resuscitation and Emergency Cardiovascular Care". Circ 2010; 122(18 Suppl 3): S720-S728.
Chan PS, McNally B, Tang F, Kellermann A. "Recent trends in survival from out-of-hospital cardiac arrest in the United States" Circ 2014; 130(21):1876-1882.
Esibov A, Banville I, Chapman FW, Boomars R, Box M, Rubertsson S. "Mechanical chest compressions improved aspects of CPR in the LINC trial". Resuscitation 2015; 91:116-121.
Hallstrom A, Rea TD, Sayre MR et al. "Manual chest compression vs use of an automated chest compression device during resuscitation following out-of-hospital cardiac arrest: a randomized trial" JAMA 2006; 295(22):2620-2628.
Halperin, H. R., et al. "Cardiopulmonary resuscitation with a novel chest compression device in a porcine model of cardiac arrest: improved hemodynamics and mechanisms" J.Am. Coll. Cardiol. 44.11 (2004): 2214-20.
Hostler D, Everson-Stewart S, Rea TD et al. "Effect of real-time feedback during cardiopulmonary resuscitation outside hospital: prospective, cluster-randomised trial" BMJ 2011; 342:d512.
Lurie, K.G., Improving active compression-decompression cardiopulmonary resuscitation with an inspiratory impedance value, Abstract Circulation 1995; 91/6 (1 page abstract).
Neumann T, Gruenewald M, Lauenstein C, Drews T, Iden T, Meybohm P. "Hands-on defibrillation has the potential to improve the quality of cardiopulmonary resuscitation and is safe for rescuers-a preclinical study". J Am Heart Assoc 2012; 1(5):e001313.
Ong ME, Annathurai A, Shahidah A et al. "Cardiopulmonary resuscitation interruptions with use of a load-distributing band device during emergency department cardiac arrest". Ann Emerg Med 2010; 56(3):233-241.
Ong, M. E., et al. "Use of an automated, load-distributing band chest compression device for out-of-hospital cardiac arrest resuscitation " JAMA 295.22 (2006): 2629-37.
Paradis, N. A. "Is this the next step for CPR?" Am. J. Emerg. Med. 18 34.1 (2016): 97-99.
Paradis, N. A., et al. "Coronary perfusion pressure during external chest compression in pseudo-EMD, comparison of systolic versus diastolic synchronization." Resuscitation 83.10 (2012): 1287-91.
Plaisance P, Lurie KG, Payen D. "Inspiratory impedance during active compression-decompression cardiopulmonary resuscitation: a randomized evaluation in patients in cardiac arrest". Circ 2000; 101(9):989-994.
Plaisance, P., et al. "Use of an inspiratory impedance threshold device on a facemask and endotracheal tube to reduce intrathoracic pressures during the decompression phase of active compression-decompression cardiopulmonary resuscitation." Crit Care Med. 33.5 (2005): 990-94.
Qvigstad et al., "Clinical pilot study of different hand positions during manual chest compressions monitored with capnography". Resuscitation 84 (2013) 1203-1207, www.elsevier com/locate/resuscitation.
Rubertsson S, Lindgren E, Smekal D et al. "Mechanical chest compressions and simultaneous defibrillation vs conventional cardiopulmonary resuscitation in out-of-hospital cardiac arrest: the LINC randomized trial". JAMA 2014; 311(1):53-61.
Rudikoff, M. T., et al. "Mechanisms of Blood Flow During Cardiopulmonary Resuscitation." Circulation 61 (1980): 345-52.
Sanders AB, Kern KB, Ewy GA, Atlas M, Bailey L. "Improved resuscitation from cardiac arrest with open-chest massage". Ann Emerg Med 1984; 13(9 Pt 1):672-675.
Shinar Z, Bellezzo J, Paradis N et al. "Emergency department initiation of cardiopulmonary bypass: a case report and review of the literature" J Emerg Med 2012; 43(1):83-86.
Stephenson HE, Corsan Reed L, Hinton JW. "Some Common Denominators in 1200 cases of cardiac arrest". Ann Surg 1953; 137:731-744.
Stiell IG, Nichol G, Leroux BG et al. "Early versus later rhythm analysis in patients with out-of-hospital cardiac arrest". N Engl J Med 2011; 365(9):787-797.
Wik L, Olsen JA, Persse D et al. "Manual vs. integrated automatic load-distributing band CPR with equal survival after out of hospital cardiac arrest. The randomized CIRC trial" Resuscitation 2014; 85(6):741-748.

* cited by examiner

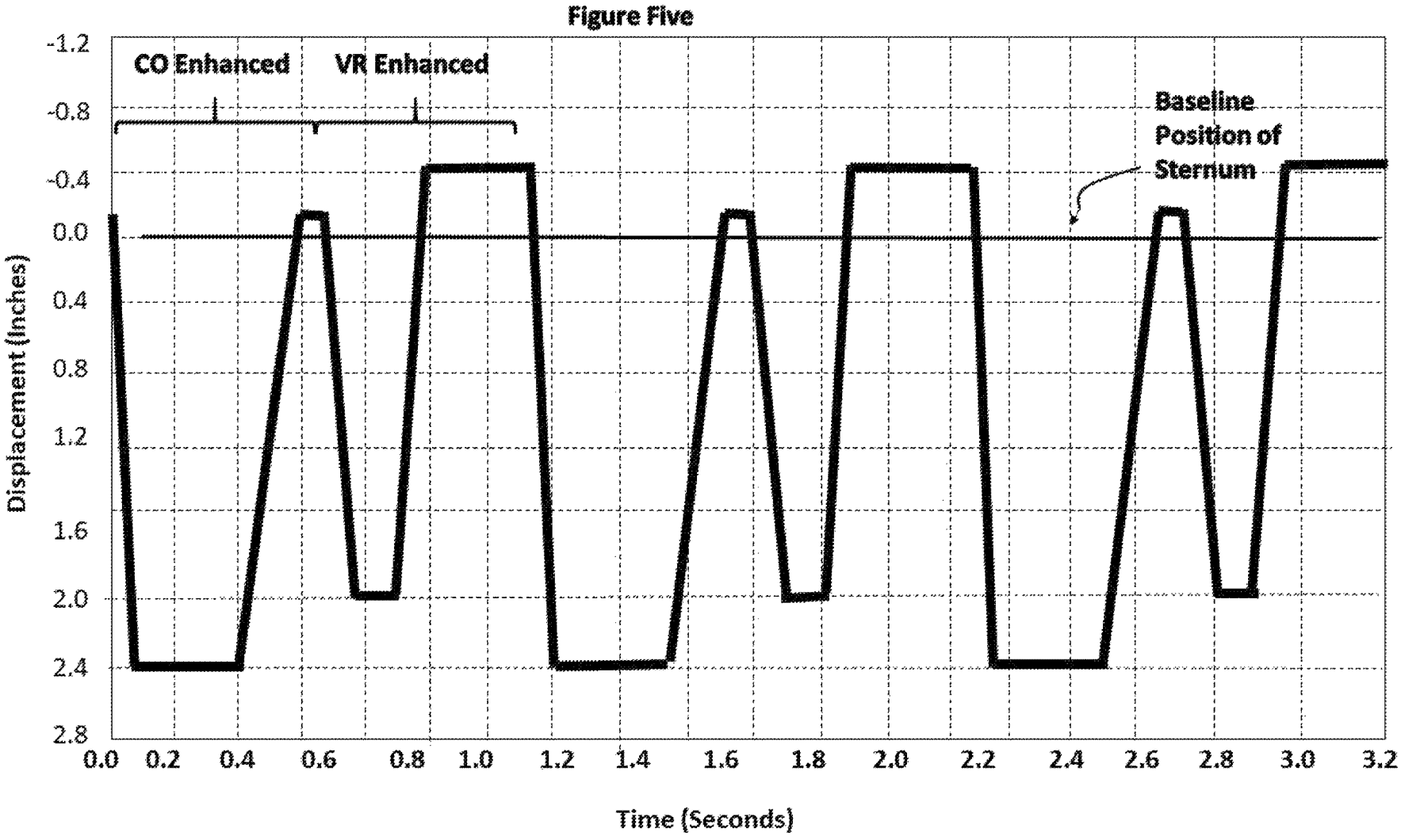
Figure Five
CO Enhanced
VR Enhanced
Baseline Position of Sternum
Displacement (Inches)
-1.2
-0.8
-0.4
0.0
0.4
0.8
1.2
1.6
2.0
2.4
2.8
0.0
0.2
0.4
0.6
0.8
1.0
1.2
1.4
1.6
1.8
2.0
2.2
2.4
2.6
2.8
3.0
3.2
Time (Seconds)

Figure Six
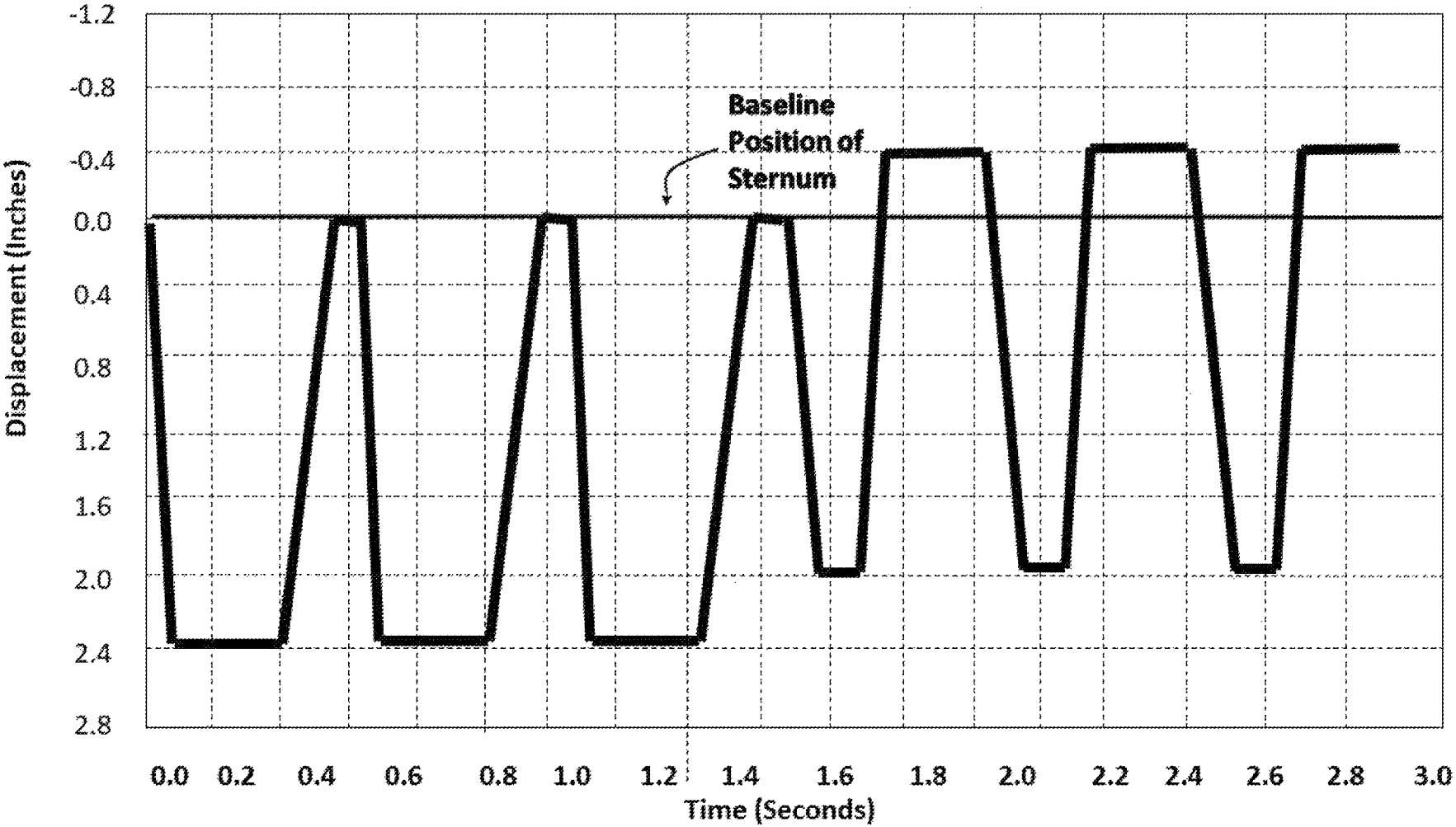

Figure Seven
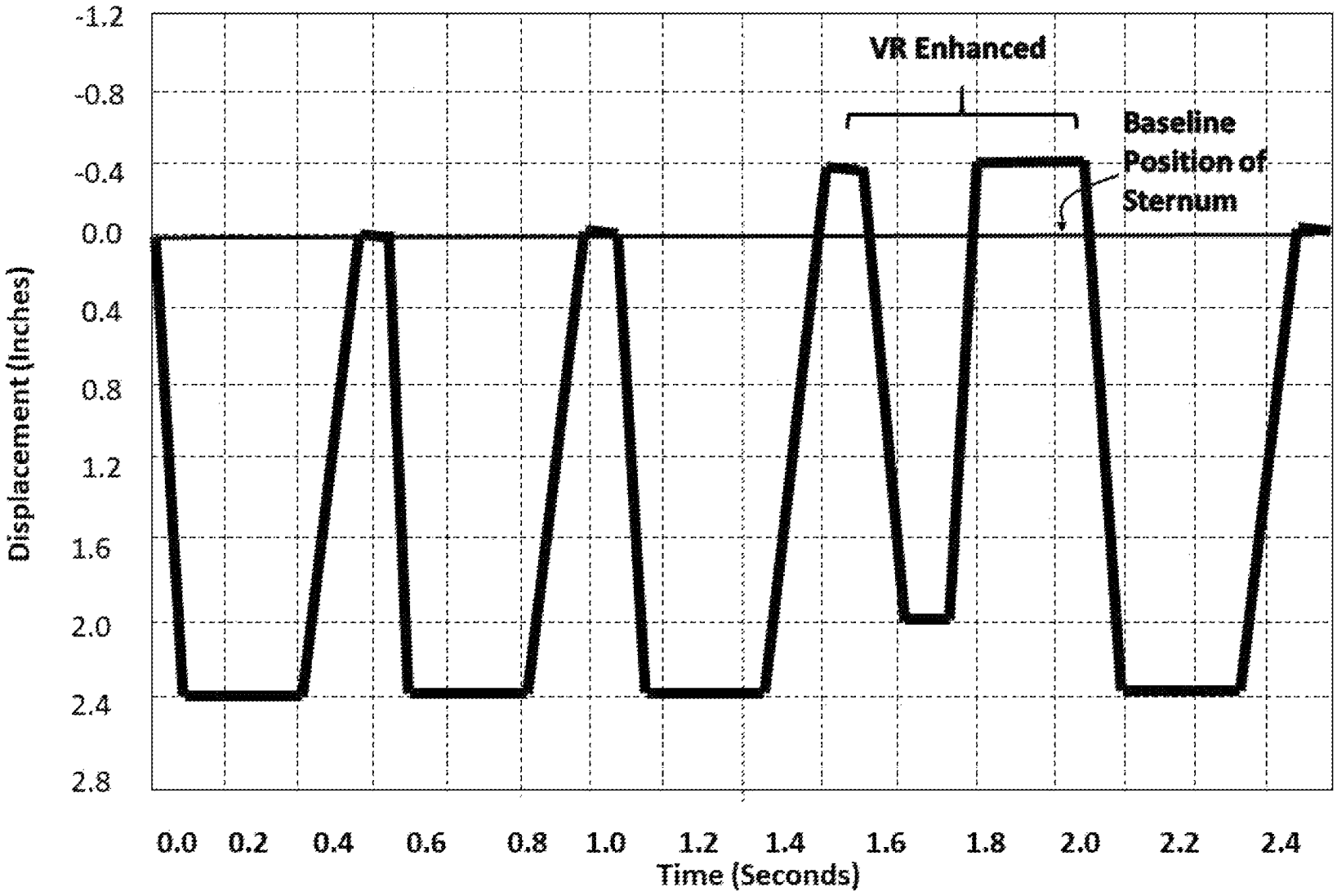

METHOD TO INCREASE THE EFFICACY OF CARDIOPULMONARY RESUSCITATION BY MEANS OF ALTERNATING PHASES DURING WHICH THE PHYSICAL CHARACTERISTICS OF CHEST COMPRESSION ARE VARIED SO AS TO INCREASE OVERALL FORWARD BLOOD FLOW

BACKGROUND OF THE INVENTION

Hemodynamics is the forward movement of blood. As such, it is required for the maintenance of life in any organism with a separate vascular system. In an intact organism, the vascular system is composed of a pumping mechanism—the heart—and a closed circuit of arteries and veins. Arteries deliver freshly oxygenated blood to the tissues and veins return blood to the heart and lungs for replenishment of oxygen.

The circulatory system is considered to have four components: 1) a pump, 2) an arterial compartment, 3) an organ and tissue compartment, and 4) a venous compartment. Forward blood flow is achieved through a combination of cardiac output and venous return.

Additionally:

1) The pump—for these purposes the human or mammalian heart.

2) The arterial compartment-blood vessels connecting the heart to the various organs and tissues of the body. Generally filled with oxygenated blood under some differential pressure.

3) The tissue compartment-capillaries within the organs and tissues of the body. Oxygen exchange and waste product removal occur here.

4) The venous compartment-connecting the tissues and organs of the body to the heart. Filled with venous blood that is relatively deoxygenated and relatively enriched with carbon dioxide and other waste products of metabolism. The pressure in the venous compartment is generally lower than in the arterial compartment.

In the intact organism, the heart achieves circulation means of cardiac output and venous return, the pressure within the arterial compartment being greater than the venous compartment. In the steady-state, each heart beat is similar to any other and incorporates components intended to achieve cardiac output and venous return. Generally, mammals respond to the need for greater cardiac output by means of increasing stroke volume and heart rate. It is possible to induce forward blood flow to during cardiac arrest by application of external force to the thorax. (Kouwenhoven, Jude, and Knickerbocker 1960; CARDIAC ARREST—The Science and Practice of Resuscitation Medicine 96) Most commonly, this has been achieved by providing anteroposterior compression of the mid-chest in the area of the sternum, usually with a piston like mechanism.

The combination of chest compressions and rescue breathing is called basic life support (BLS). Since its initial adoption, multiple improvements to basic life support have been proposed. Although incremental changes in parameters such as the rates of rescue breathing and chest compression have been widely adopted, (Kleinman et al. 2015) qualitatively different techniques have not become routine. While it has been possible to demonstrate some improvement in outcome in animal models with techniques such as abdominal counterpulsation, (Ralston, Babbs, and Niebauer 1982) circumferential constrict (Halperin et al. 1993) and active decompression, (Cohen, Tucker, Lurie, et al. 1992) the degree of improvement has been insufficient to result in widespread clinical adoption. In almost all cases, changes to basic life support have either a) not been evaluated in clinical trials, b) have failed in clinical trials, or c) have had only modest effectiveness when utilized clinically. Overall, there have not been large increases in the rate of return of spontaneous circulation once cardiac arrest has occurred.

Therefore, there is a significant and important need for improved techniques of cardiopulmonary resuscitation (CPR).

Normal cardiac output in a healthy adult is in the range of 4.7 liters per minute. This output maintains a mean arterial compartment blood pressure of approximately 90 mm Hg. The human heart responds to greater needs for blood flow by increasing rate and the force of contraction.

However, during cardiac arrest, CPR is only able to generate hemodynamics that are a fraction of an intact circulation. Often, they are in the range of 20% of normal cardiac output. (Michael et al. 1984) This large decrease in cardiac output results in mean arterial blood pressures that are often in the range of 25 mm Hg. (Paradis et al. 1989) The low cardiac outputs and arterial compartment pressures result in poor vital organ perfusion, and increased blood transit times. Loss of vasomotor tone in both the atrial and venous compartment acts to exacerbate the loss in hemodynamics. Blood begins to collect in the venous compartment, which raises venous pressures. The motive force for arterial to venous circulation is the difference in pressures between the two compartments. The abnormally low atrial mean pressures and abnormally high venous mean pressures act together to create a low perfusion pressures.

All of these decrements to perfusion and hemodynamics during CPR mean that cardiac output, flow out of the arterial compartment, and return flow from the venous compartment are all only a fraction of native circulation.

In native circulation, cardiac outputs, ventricular stroke volumes, tissue flows, and venous return are generally in equilibrium. Under normal circumstances, one of the vascular compartments does not expand significantly with respect to the other compartments over time frames of minutes. This may not be the case under the extreme low-flow of cardiac arrest and CPR. The relative expansion of the venous compartment may result in inadequate volume on the arterial side of the circulation. This, in turn, may result in impaired cardiac output.

Relative to the volumes of the vascular compartments, the cardiac output during cardiac arrest and CPR is generally inadequate for optimal forward flow and restoration of spontaneous circulation. It has not previously been realized that this inadequacy may be exacerbated by CPR chest compression decompression cycles CCDCs of a single type that has been designed with the intention of being optimal overall. Such CCDCs may be a trade-off between compressions optimized for cardiac output (cardiac output optimized CCDCs) versus compressions optimized for venous return (venous return optimized CCDCs).

It may be possible to improve overall forward flow by first performing a series of CCDCs optimized for cardiac output followed by a series optimized for venous return or visa versa. Such an approach might first expand and pressurize the arterial compartment causing improved flow through the tissue compartment and into the venous compartment.

If the patient then receives a series of CCDCs optimized for venous return, this might enhance flow back to the heart or thorax and act to optimize the subsequent cardiac output optimized compressions. Such a method may transform the arterial and venous compartments into components of a whole body CPR pump.

For the purposes of clarity, the following terms are used in describing CPR based on movement of the chest or abdomen:

1) Chest compression: during CPR this is the forceful downward movement of the anterior chest (FIG. 1) 1. This may be achieved by a rescue provider or mechanically with a device.

2) Chest relaxation: release of the anterior chest, allowing it to move forward towards its normal position 2. This is usually achieved by releasing force on the hands or piston device.

3) Chest decompression: for the purposes of this discussion, this may be either the same as chest relaxation 2, or it may be active, that is forceful, decompression 3.

4) Chest compression-decompression cycle: For the purposes of this discussion, a single cycle incorporating the downward forceful compression of the chest 1, the interval during which the chest remains compressed 4, the upward release or forceful decompression 2,3 and the interval until the next compression 5. (FIG. 1) For these purposes, it is understood circumferential or partial circumferential constriction of the thorax may be the method of chest compression. (Halperin et al. 1993)

5) Active chest decompression: upward forceful decompression of the anterior chest 3.

6) Circumferential compression: during CPR, elevation of the intrathoracic pressure for the purposes of creating hemodynamics achieved by application of force around the chest.

7) Abdominal compression: application of force to the anterior abdomen as a component of CPR.

8) Abdominal counterpulsation: application of force to the anterior abdomen during the relaxation or decompression phase of chest compressions.

9) Conventional CPR: CPR in which the CCDCs are identical (FIGS. 1,2).

10) Alternating pattern CPR (AP-CPR): Implementing multiple methods of CPR such as, but not solely limited, to those described herein in an alternating pattern, which relates to the invention described herein. The CCDCs are varied so as to improve overall forward blood flow and/or hemodynamic efficacy (FIGS. 5,6,7).

To understand the current invention, it is important to know that, the methods, techniques, components, and enhancements of cardiopulmonary resuscitation based on manipulation of the external chest and/or abdomen may be considered to fall into two broad categories: 1) those that directly create or enhance forward flow (cardiac output), and 2) those that create or enhance venous return.

Mechanistically, it is reasonable to assume that components of the CPR cycle that create or enhance cardiac output act to pressurize the arterial compartment. This will increase flow from the arterial compartment into the tissue compartment. Subsequent increased flow in the tissue compartment will result in increased flow into the venous compartment. The expansion and increased pressure of the venous compartment will enhance flow back to the heart, which is venous return. And finally, enhanced venous return may prime the CPR pump for increased cardiac output and forward-flow on the next cycle.

The mechanistic understanding of CPR hemodynamics is limited by a general lack of agreement as to the actual pump. (Haas et al. 2003) Some authorities believe that the heart continues to function as a pump mechanism, (Bircher, Safar, and Stezoski 1982) while others believe that the thorax becomes functionally the pump during CPR. (Niemann et al. 1980; Weisfeldt, Chandra, and Tsitlik 1981) It is possible that the mechanism of CPR is a combination of cardiac and thoracic pumps, and that the proportional contribution of each mechanism is variable patient to patient. Methods intended to increase cardiac output during CPR include, but are not limited to (FIG. 3):

1. Greater compressive or constrictive force/speed/depth 6
2. Greater depth of compression 7
3. More frequent compressions
4. Longer compression phase 8-shorter relaxation phase 9

Methods intended to increase venous return during cardiopulmonary resuscitation include, but are not limited to (FIG. 4):

1. Active decompression 3
2. Increased force/speed during active decompression 10
3. Active decompressing the chest wall to a location above its native anatomic position 11
4. Prolonged decompression phase 12 or shortened compression phase 13
5. Airway occlusion during decompression so as to create greater relative negative intrathoracic pressure
6. Combination of active decompression and airway occlusion. (Wang et al. 2015)

Examples of forward flow cardiac output enhancing techniques include, but are not limited to, standard anteroposterior chest compression and circumferential constriction. (Kouwenhoven, Jude, and Knickerbocker 1960; Halperin et al. 1993) Examples of techniques that may enhance venous return include, but are not limited to, active decompression of the chest (Cohen, Tucker, Lurie, et al. 1992), abdominal counterpulsation (Voorhees, Niebauer, and Babbs 1983), and partial airway obstruction during inhalation—the so called impedance threshold device. (Wolcke et al. 2003)

The improvement in hemodynamics associated with active decompression 3 may be mechanistically mediated by creation of increased negative intrathoracic pressure during the active decompression phase of CPR 10 with resulting enhancement of venous return. Additional enhancement of negative intrathoracic pressure and venous return may be achieved by briefly obstructing the airway during the decompression release phase. (Plaisance et al. 1999) Typically, this is achieved through utilization of a cracking valve mechanism called an impedance threshold device.

In addition to compression and decompression of the chest, compression and decompression of the abdomen, either independently or in a synchronized pattern with the chest compressions, has been proposed as potentially enhancing overall hemodynamics during CPR. (Ralston, Babbs, and Niebauer 1982; Babbs 1984) It is theoretically possible that these abdominal techniques may have independent and variable effects on cardiac output or venous return.

Additionally, alterations in ventilation, either independently or in a synchronized pattern with the chest compressions, has been proposed as potentially enhancing overall hemodynamics during CPR. (Segal 2014) In particular, transient occlusion of the airway during relaxation phase has been demonstrated to enhance negative intrathoracic pressure and venous return. It is theoretically possible that alterations in the parameters of ventilation may have independent and variable effects on cardiac output or venous return.

Previous to this disclosure, all existing methods of CPR have incorporated patterns of CCDC in which each CCDC was intended to be of similar intent to the one before or after.

All previous methods have been intended to optimize hemodynamics during CPR by identifying an ideal CCDC optimized overall with respect to both cardiac or thoracic output and venous return, and to use that ideal pattern throughout. Changes to these idealized CCDCs have been limited to force, rate, and location.

All previous devices, methods, and systems have attempted to enhance overall CPR hemodynamic effectiveness only at the level of the single CCDC. It has not previously been taught that overall forward flow may be greater when alternating between single CCDCs or groups of CCDCs that are different with respect to their cardiac output and venous return enhancing components. Alternatively, there is no previous description of a single CCDC or group of CCDCs being intentionally sub-optimal with respect to either cardiac output or venous return so as to enhance the other parameter and overall forward flow.

Previous attempts at improving overall CPR performance have included greater force, greater depth, greater frequency, active forceful decompression, abdominal counterpulsation, and synchronized ventilations, (Berkowitz et al. 1989) among others. Additionally, feedback related to operator performance or patient status has been used to adjust the CCDC patterns. (Abella et al. 2007; Yeung et al. 2009) But importantly, the adjustments in response to feedback have been limited to an increase or decrease in the already chosen CCDC pattern, or a wholesale change to another pattern (i.e. a change from standard CPR to active compression-decompression CPR) not a variable pattern of alternating CCDCs.

The previous universal limitation of CPR chest compressions to one type at any given moment may have reflected a belief that CPR should mimic native circulation, and the assumption that an optimized single CCDC pattern provided the best solution with respect to maximal overall hemodynamics and patient outcome. This assumption is unproven.

Once it has been learned that alternating either single or multiple CCDCs optimized for arterial cardiac output with single or multiple CCDCs optimized for venous return might result in overall improved systemic hemodynamics and patient outcome, mechanisms to design cardiac output and venous return optimized CCDCs may be considered.

Importantly, examination of the list of parameters believed to enhance cardiac output, and the alternative list of parameters believed to enhance venous return demonstrates that some of these parameters are mutually exclusive. In example, consider the possibility that the forces creating cardiac output are greatest during the chest compression phase, and forces creating venous return are greatest during relaxation phase. Of necessity, extending compression phase to augment cardiac output must occur at the expense of venous return during relaxation phase, and vice versa. Thus, it is not be possible to design a single CCDC optimized with both prolonged relative compression and relaxation phases. It may also not be possible to design a single CCDC pattern that optimally pressurizes the arterial compartment and optimally decompresses the venous compartment.

FIELD OF THE INVENTION

The invention disclosed here relates in general to the field of cardiopulmonary resuscitation (CPR), and more particularly, to a method for improving hemodynamics and clinical outcome.

DESCRIPTION OF THE RELATED ART

Devices for providing anteroposterior compression CPR are well known. (McDonald 1982) Generally, these are piston based devices, with the piston held in position anterior to the patient by a structural arm or arch that acts like a gantry.

Devices for providing active anteroposterior decompression are well known. (Cohen, Tucker, Redberg, et al. 1992)

Devices to enhance negative intrathoracic pressure and venous return are well known. (Plaisance et al. 1999)

SUMMARY

A method for improving CPR hemodynamics and clinical outcome of patients suffering cardiac arrest and other low-flow states by varying the CCDCs so as to create intervals optimized for differing hemodynamics purposes. In one embodiment, there are alternating phases during which the CCDCs are optimized for cardiac output and others during which they optimized for venous return.

BRIEF DESCRIPTION OF THE DRAWINGS

Current recommendations for the treatment of adults in cardiac arrest are that. chest compressions be performed at a rate of 100 to 120 compressions per minute to a depth of at least 2 inches. (Kleinman et 2015) For the purposes of the figures below, the rate of 100 compressions per minute and a dep 2 inches will be utilized as standard. At this rate, each CCDC will have a duration of 600 ms and standard compression and relaxation phases durations of 300 ms.

A person having ordinary skill in the art will understand that the waveforms in the figures below may equally well. represent intrathoracic pressure.

FIG. 5: Chest displacement during mechanical CPR, alternating CCDC's enhanced for cardiac output and CCDC's enhanced for venous return (1 CCDC:1 CCDC ratio)

FIG. 6: Chest displacement during mechanical CPR, alternating CCDC's enhanced for cardiac output and CCDC's enhanced for venous return (3 CCDC:3 CCDC ratio)

FIG. 7: Chest displacement during mechanical CPR, alternating CCDC's enhanced for cardiac output and CCDC's enhanced for venous return (3 CCDC:1 CCDC ratio)

DETAILED DESCRIPTION

Figure 1:
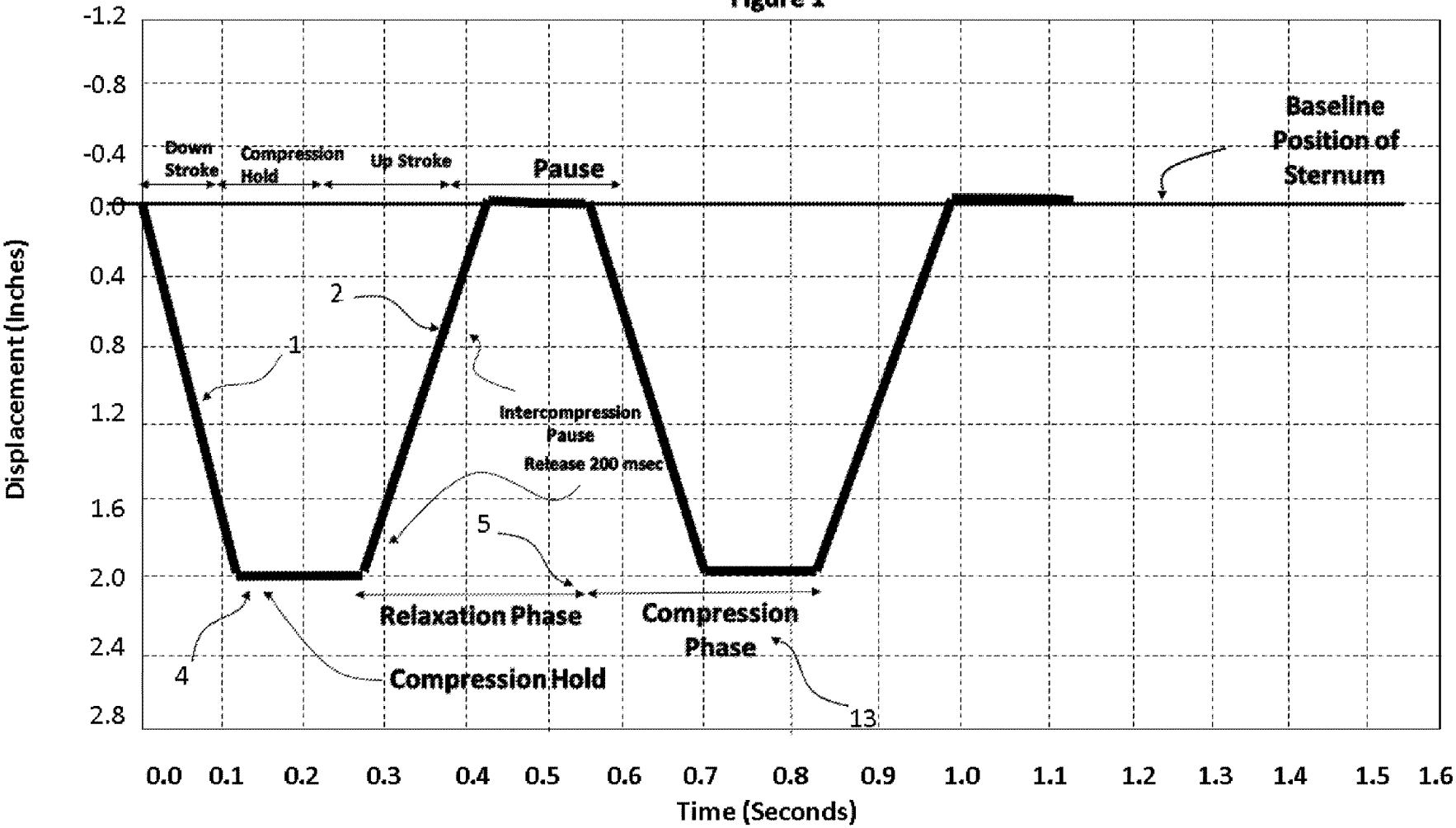
FIG. 1—Idealized chest displacement during standard mechanical chest compressions (two compressions and one intervening relaxation)
Figure 2:
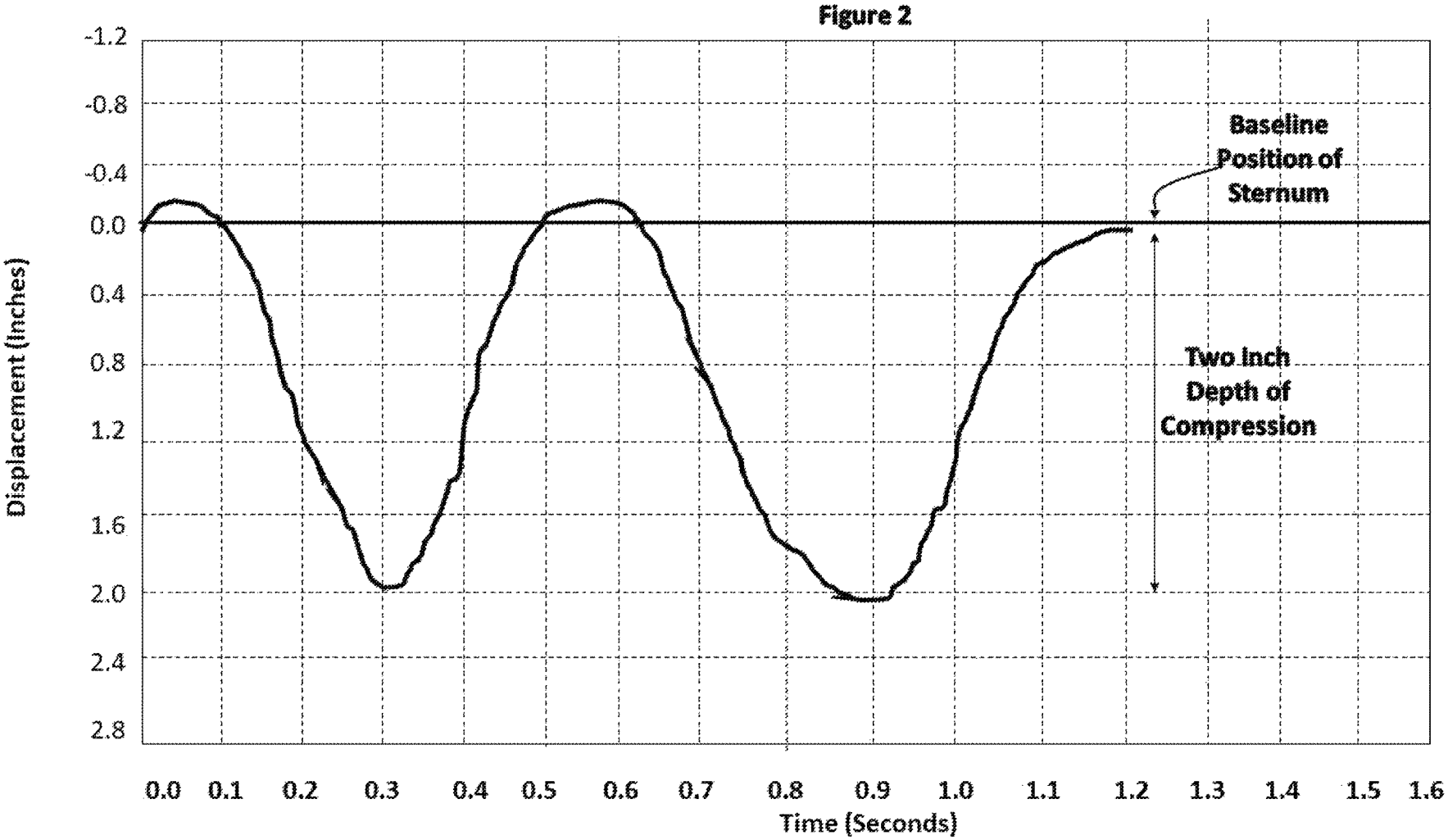
FIG. 2—Chest displacement during standard manual chest compressions (two compressions and one intervening relaxation)
Figure 3:
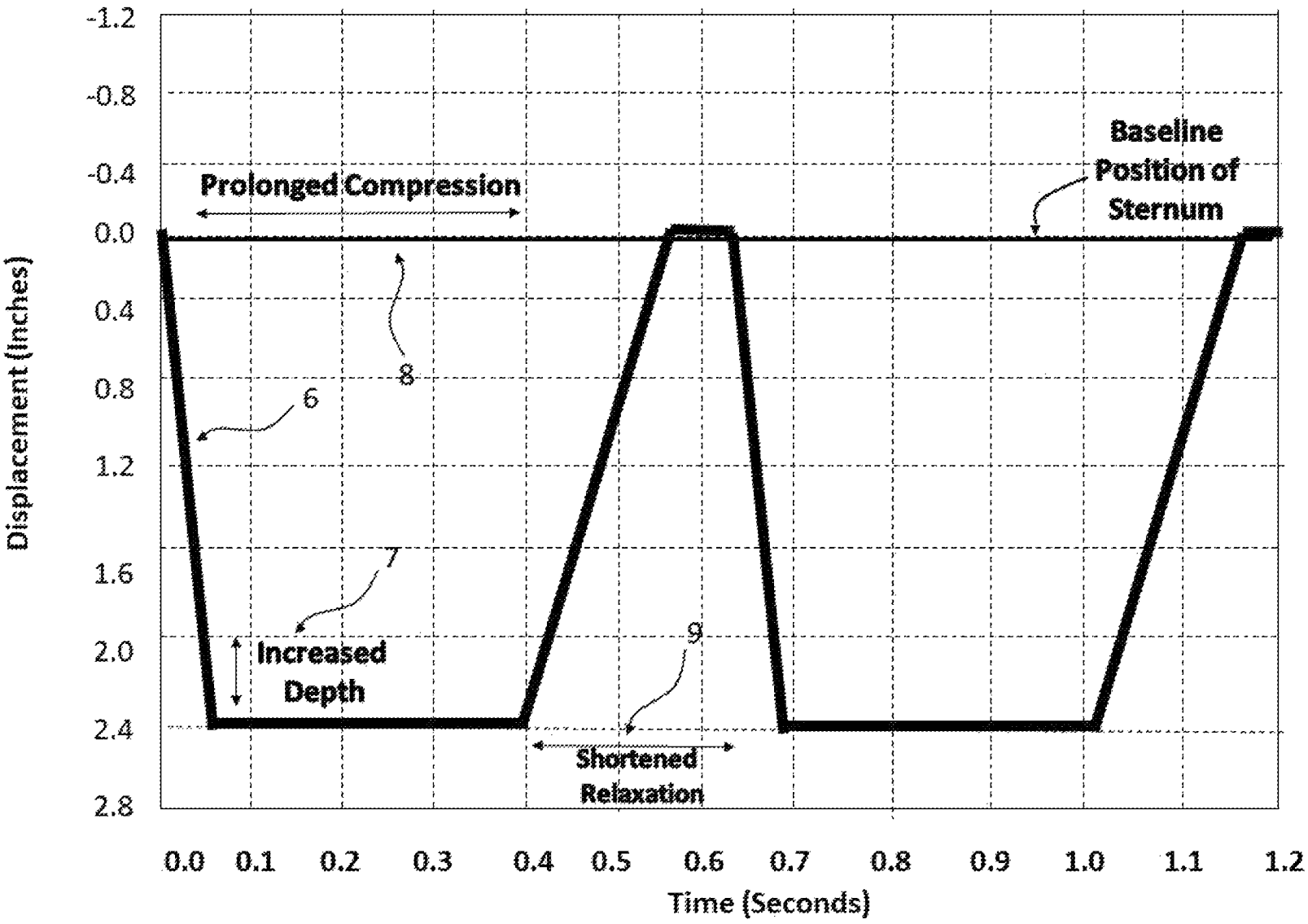
FIG. 3—Chest displacement during mechanical CPR, CCDC's enhanced for cardiac output relative to venous return. Specifically illustrated are: a greater force/speed/depth of compression (slope down) 6, a greater duration of compression 8, and a shorter durations of relaxation 9 (two compressions and one intervening relaxation)
Figure 4:
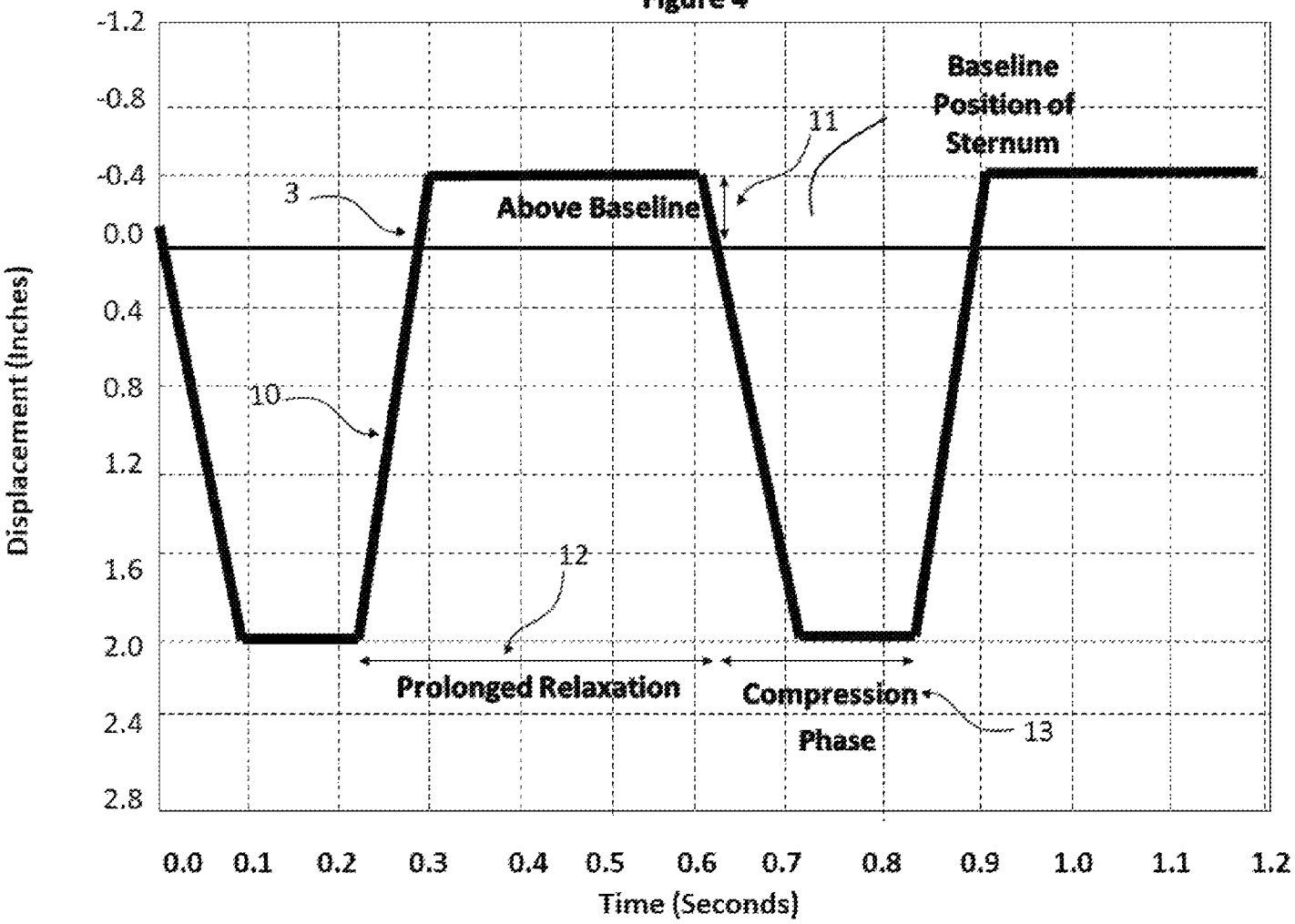
FIG. 4—Chest displacement during mechanical CPR, CCDC's enhanced for venous return relative to cardiac output. Specifically illustrated are: active decompression (slope up) 3, relaxation phase chest wall location above baseline 11, and longer durations of relaxation 12. (two compressions and a relaxation)

Previous to this disclosure, conventional devices and techniques of CPR were applied with a uniform pattern of CCDCs.

Previous to this disclosure, it has not been taught that overall forward flow and efficacy might be augmented by alternating intervals or phases during which CCDCs are optimized toward different objectives. By way of example, but not limitation, it might be more effective overall to have alternating time intervals during which one phase has CCDCs optimized for cardiac output and another composed of CCDCs optimized for venous return.

Once taught the invention, a person having ordinary skill in the art may appreciate that with this enhancement the major compartments of the circulatory system may not be in continuous equilibrium. Rather, during the phase of the cycle in which the CCDCs are optimized for cardiac output, the arterial compartment may become pressurized relative to the tissue and venous compartments. If this pressure differential moves blood from the arterial compartment to the tissue compartment and then into the venous compartment, the venous compartment may become relatively pressurized. Subsequently, during the phase in which the CCDCs are optimized for venous return, the venous compartment would be drained with increased returned blood flow to the heart.

Under this alternating pattern CPR (AP-CPR), a pattern may be established in which there is sequential volume expansion and pressurization of first the arterial compartment, then the tissue compartment and finally the venous compartment. As such, the arterial and venous compartments may be considered components of a systemic pumping mechanism rather than simply conduits. Flow within the tissues may take on a more sinusoidal pattern.

As a result of alternating between cardiac-output optimized CCDCs and venous-return optimized CCDCs, the overall hemodynamic efficacy, for example the minute-volume of blood flow through an organ of interest, is improved relative to what could be achieved by either of the two types of CCDCs alone.

In implementing such a preferred embodiment, a practitioner of ordinary skill in the art would know that CCDCs optimized for cardiac output would include, but are not limited to CCDCs of:

1. Greater compressive force/speed than a previous target which may have been otherwise recommended or set for compressive force/speed. For example, the speed and/or force of compression may be increased, or the time interval of the chest compression relaxation phase 9 to less than 100 milliseconds while maintaining force unchanged. Additionally, greater than standard compression depths may be used (i.e. 2.0-2.4 inches) 7. Hence, the force applied to the chest to reach a target range of 2.0-2.4 inches may be greater during a time interval of less than 100 milliseconds in comparison to a time interval of 100 milliseconds or longer. The application of such force during compression may result in greater cardiac output of blood from the heart to the arterial compartment.

2. Greater depth of compression than a previous target which may have otherwise been recommended or set for compression depth 7. For example, the target compression depth that would normally be set to a recommended standard compression depth of 2.0-2.4 inches may be increased to a range of compression depths of 2.4-4 inches. By compressing to a greater depth than the typically recommended 2.0-2.4 inches, more blood would be expected to be output from the heart to the surrounding tissues.

3. More frequent compressions than a previous target which may have otherwise been recommended or set for compression rate. For example, the target compression rate that may typically be set to a standard rate of 100-120 compressions per minute may be increased to a range of compression rate of 120-200 compressions per minute. Compressing the chest at such an increased rate may result in an overall larger volume of blood being output from the heart to surrounding tissues than would otherwise be the case at lower rates of compression.

4. Shortened relaxation phase 9 as compared to conventional time intervals 5 for the relaxation phase of a chest compression. For example, the time interval of the relaxation/decompression phase, may be decreased from a standard duration of approximately 400 milliseconds to a duration of 1-300 milliseconds. Shortening the duration of the relaxation/decompression may allow for a subsequent chest compression to be initiated sooner, resulting in increased overall rate and/or force/pressure on the chest of the patient to move blood forward.

A person having ordinary skill in the art, may additionally appreciate that alterations in the abdomen and/or ventilations may adjunctively augment overall hemodynamics during CCDCs optimized for cardiac output. These alterations may be synchronized with specific alterations in the cardiac output or venous return optimized CCDCs.

In implementing such a preferred embodiment, a practitioner of ordinary skill in the art would also know that CCDCs optimized for venous return would include, but are not limited to CCDCs of:

1. Active decompression, involving the upward forceful decompression of the anterior of the chest. Such an upward forceful action resulting in a greater negative intrathoracic pressure within the chest cavity that results in enhanced venous return from surrounding tissues back to the heart.

2. Increased force/speed active decompression as compared to typical decompression. For example, the speed at which the anterior of the chest is forcefully pulled upward may be increased by lowering the time interval of the decompression to less than 100 milliseconds for a standard compression depth of 2.0-2.4 inches. The application of a relatively greater upward force on the anterior of the chest due to the increased speed of the active decompression phase would lead to an increased magnitude of negative intrathoracic pressure, resulting in improved venous return of blood to the heart from the surrounding tissues.

3. Prolonged decompression phase 12 to provide increased opportunity for movement of blood back to the heart. For example, the time interval of the relaxation/decompression may be increased from a standard duration of approximately 400 milliseconds to a duration of 400-1500 milliseconds. This increase in duration may allow for enhanced negative intrathoracic pressure generated during active decompression to sufficiently overcome the presence of inertial resistance to flow such that blood is effectively able to be pulled from the surrounding tissues back toward the heart.

4. Airway occlusion during decompression to restrict unnecessary air from entering into the chest cavity during decompression. For example, a valve such as that provided by the ResQPOD impedance threshold device manufactured by ZOLL Medical Corporation may be placed in the airway of the patient, (Jenkins et al. 2015) obstructing air from entering until a predetermined cracking pressure is achieved. By occluding the passage of air during the decompression phase, the effects of negative intrathoracic pressure on venous return are further enhanced.

A person having ordinary skill in the art, may additionally appreciate that alterations in the abdomen and/or ventilations may adjunctively augment overall hemodynamics during CCDCs optimized for venous return. These alterations may be synchronized with specific alterations in the venous return optimized CCDCs.

In an alternative specific embodiment, a practitioner of ordinary skill would produce a method in which there are alternating pairs of CCDCs, one cycle optimized for cardiac output, a second cycle optimized for venous return (FIG. 5).

In an alternative specific embodiment, a practitioner of ordinary skill would produce a method in which there are alternating time intervals composed of multiple CCDCs, one interval composed of multiple cycles optimized for cardiac output, a second phase composed of multiple cycles optimized for venous return (FIGS. 6,7).

Once taught this invention, a person of ordinary skill in the art, would understand that any one of a number of ratios between cardiac output enhanced CCDC's and venous return enhanced CCDC's are possible. Additionally, this ratio may be adjusted dynamically based on feedback of the patient's status.

In an alternative specific embodiment, a practitioner of ordinary skill would produce a method in which there are repeating time intervals composed of multiple CCDCs, each repeating interval composed of CCDCs that transition from cycles optimized for cardiac output to cycles optimized for venous return.

In an alternative specific embodiment, a practitioner of ordinary skill would produce a method in which there are repeating intervals composed of multiple CCDCs, each repeating interval composed of multiple CCDCs cycles that transition from cycles optimized for venous return to cycles optimized for cardiac output.

In an alternative specific embodiment, a practitioner of ordinary skill would produce a method in which the CCDCs are optimized for cardiac output through incorporation of one or more selected from the group consisting of: greater compressive force, greater compressive speed, greater depth of compression, more frequent compressions, prolonged compression phase relative to relaxation, lessened active decompression, decreased force of decompression, decreased speed of decompression, shortened decompression phase.

In an alternative specific embodiment, a practitioner of ordinary skill would produce a method in which the CCDCs are optimized for venous return through incorporation of one or more selected from the group consisting of: greater active decompression, increased force of decompression, increased speed of decompression, lengthened decompression phase, lessened compressive force, lessened compressive speed, lessened depth of compression, prolonged decompression phase.

Alternatively, CCDCs may be provided that transition incrementally from ones that are solely intended to enhance venous return through CCDCs that blend venous return and cardiac output enhancing characteristics to CCDCs that are solely intended to enhance cardiac output. The oscillation through this cycle would be alternated with a time period that is itself optimized empirically or through feedback to enhance overall system forward flow.

For purposes of illustration and not limitation, a practitioner of ordinary skill in the art would, once taught the invention, be able to construct particular preferred embodiments wherein:

1. The ratio of the time intervals is one to one.
2. The ratio of the time intervals is not one to one.
3. The duration of the time intervals is equal.
4. The duration of the time intervals is not equal.
5. The duration or ratio patterns of the two time intervals is adjusted based on a biomarker measurement obtained from the patient that assists in determining hemodynamic efficacy.
6. The pattern of transition from CCDCs optimized for cardiac output to CCDCs optimized for venous return is adjusted based on a biomarker measurement obtained from the patient that assists in determining hemodynamic efficacy.
7. The cardiopulmonary resuscitation is provided by circumferential or partial circumferential constriction and relaxation.
8. The CCDCs are provided by a mechanical device.
9. The CCDCs are provided by an automated chest compression device.
10. The ratio or sequence of CCDCs is variable based on feedback of patient status.
11. The cardiac output enhancing CCDCs, or their respective phases, are further enhanced by phasic manipulation of the abdomen.
12. The venous output enhancing CCDCs, or their respective phases, are further enhanced by phasic manipulation of the abdomen.
13. The cardiac output enhancing CCDCs, or their respective phases, are further enhanced by phasic alteration in ventilation pattern or pressures.
14. The venous output enhancing CCDCs, or their respective phases, are further enhanced by phasic alteration in ventilation pattern or pressures.
15. The cardiac output enhancing CCDCs, or their respective phases, are further enhanced by phasic alteration in the patient's body position or a portion of the patient's body chosen from a list that includes the head, neck, chest, abdomen, arms or legs.
16. The venous output enhancing CCDCs, or their respective phases, are further enhanced by phasic alteration in the patient's body position or a portion of the patient's body chosen from a list that includes the head, neck, chest, abdomen, arms or legs.
17. The alternating CCDCs and the phases of alternating CCDCs are provided by manually applied compressions in which the person providing chest compressions is assisted in the provision of cardiac output enhancing CCDCs and venous return enhancing CCDCs by biomarker and performance feedback.
18. The patients whole body is accelerated intermittently and in a manner synchronized to specific portions of the CCDCs such that cardiac output or venous return are further enhanced.

There are components of the invention that, while sufficient, are interchangeable within the context of the invention. With the benefit of the present disclosure, a practitioner skilled in the art would know which specific embodiments of these components to incorporate in optimizing performance of the invention.

Usefulness of the Disclosed Invention

Once it is understood and appreciated that the invention disclosed herein is for a method to improve CPR hemodynamics and the clinical outcome of patients suffering cardiac arrest, the usefulness will be manifest to anyone with ordinary skill in the art.

Non-Obviousness and No Prior Art

The non-obviousness of the invention herein disclosed is demonstrated by the complete absence of its description, appreciation or discussion in the medical or intellectual property literature. Additionally, a number of large commercial enterprises produce devices for mechanical CPR; despite extensive research and development enterprises, none of these companies have disclosed or developed methods or systems such as disclosed herein.

Previous methods and systems have attempted to enhance overall CPR hemodynamic effectiveness at the level of the single compression. Extensive review of the medical/patent literature has revealed no description of a method or system in which any single CPR compression/decompression is intentionally made sub-optimal with respect to its effect on arterial side forward flow so as to enhance venous side forward flow-essentially proving that the methods described herein have not previously been envisioned.

Critical Component

Once it is understood and appreciated that the invention disclosed herein is for a method to improve the efficacy of CPR delivered or controlled by electrical and/or mechanical devices, it will be immediately appreciated that the methods described are critical components of the relevant structures within these devices or methods.

Sufficiency of Disclosure

Once taught the invention by means of this specification, a person of ordinary skill would be able to adapt known techniques and devices that provide chest compression by way of motor or pneumatic driven pistons or belts such that their standard control systems direct the device to provide CCDCs that are alternatively cardiac output and venous return enhancing as described. These CCDCs have been described in similar sufficient detail.

Modifications

It will be understood that many changes in the details, materials, steps and arrangements of elements, which have been herein described and illustrated in order to explain the nature of the invention, may be made by those skilled in the art without departing from the scope of the present invention.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

Other Publications Incorporated in the Current Application by Reference

Abella, B. S., D. P. Edelson, S. Kim, E. Retzer, H. Myklebust, A. M. Barry, N. O'Hearn, T. L. Hoek, and L. B. Becker. 2007. 'CPR quality improvement during in-hospital cardiac arrest using a real-time audiovisual feedback system', *Resuscitation,* 73: 54-61.

Babbs, C. F. 1984. 'Preclinical studies of abdominal counterpulsation in CPR', *Ann. Emerg. Med,* 13: 761-63.

Berkowitz, I. D., T. Chantarojanasiri, R. C. Koehler, C. L. Schleien, J. M. Dean, J. R. Michael, M. C. Rogers, and R. J. Traystman. 1989. 'Blood flow during cardiopulmonary resuscitation with simultaneous compression and ventilation in infant pigs', *Pediatr. Res,* 26: 558-64.

Bircher, N., P. Safar, and S. W. Stezoski. 1982. 'Do Intrathoracic Pressure Fluctuations or Heart Compression Move Blood During External Cardiopulmonary Resuscitation?(Abst)', *Anesthesiology,* 3: S150.

CARDIAC ARREST—*The Science and Practice of Resuscitation Medicine.* 96. (Williams & Wilkins: Baltimore).

Cohen, T. J., K. J. Tucker, K. G. Lurie, R. F. Redberg, J. P. Dutton, K. A. Dwyer, T. M. Schwab, M. C. Chin, A. M. Gelb, and M. M. Scheinman. 1992. 'Active compression-decompression. A new method of cardiopulmonary resuscitation. Cardiopulmonary Resuscitation Working Group [see comments]', *JAMA,* 267: 2916-23.

Cohen, T. J., K. J. Tucker, R. F. Redberg, K. G. Lurie, M. C. Chin, J. P. Dutton, M. M. Scheinman, N. B. Schiller, and M. L. Callaham. 1992. 'Active compression-decompression resuscitation: a novel method of cardiopulmonary resuscitation', *Am. Heart J,* 124: 1145-50.

Haas, T., W. G. Voelckel, V. Wenzel, H. Antretter, A. Dessl, and K. H. Lindner. 2003.'Revisiting the cardiac versus thoracic pump mechanism during cardiopulmonary resuscitation', *Resuscitation,* 58: 113-6.

Halperin, H. R., J. E. Tsitlik, M. Gelfand, M. L. Weisfeldt, K. G. Gruben, H. R. Levin, B. K. Rayburn, N. C. Chandra, C. J. Scott, and B. J. Kreps. 1993. 'A preliminary study of cardiopulmonary resuscitation by circumferential compression of the chest with use of a pneumatic vest', *N. Engl. J. Med,* 329: 762-68.

Jenkins, C., K. Brinkley, H. Alford, K. Costello, N. Korkow, D. Johnson, and L. V. Fulton. 2015. 'Effects of the ResQPOD on Kinetics, Hemodynamics of Vasopressin, and Survivability in a Porcine Cardiac Arrest Model', *Mil Med,* 180: 1011-6.

Kleinman, M. E., E. E. Brennan, Z. D. Goldberger, R. A. Swor, M. Terry, B. J. Bobrow, R. J. Gazmuri, A. H. Travers, and T. Rea. 2015. 'Part 5: Adult Basic Life Support and Cardiopulmonary Resuscitation Quality: 2015 American Heart Association Guidelines Update for Cardiopulmonary Resuscitation and Emergency Cardiovascular Care', *Circulation,* 132:S414-35.

Kouwenhoven, W. B., J. R. Jude, and G. G. Knickerbocker. 1960. 'Closed Chest Cardiac Massage', *JAMA,* 173: 1064-67.

McDonald, J. L. 1982. 'Systolic and mean arterial pressures during manual and mechanical CPR in humans', *Ann Emerg. Med,* 11: 292-95.

Michael, J. R., A. D. Guerci, R. C. Koehler, A. Shi, J. Tsitlik, N. C. Chandra, E. Niederm, M. C. Rogers, R. J. Traystman, and M. L. Weisfeldt. 1984. 'Mechanisms by which epinephrine augments cerebral and myocardial perfusion during cardiopulmonary resuscitation in dogs', *Circ,* 69: 822-35.

Niemann, J. T., J. Rosborough, M. Hausknecht, D. Brown, and J. M. Criley. 1980. 'Cough-CPR: documentation of systemic perfusion in man and in an experimental model: a "window: to the mechanism of blood flow in external CPR', *Crit Care. Med,* 8: 141-46.

Paradis, N. A., G. B. Martin, M. G. Goetting, J. M. Rosenberg, E. P. Rivers, T. J. Appleton, and R. M. Nowak. 1989. 'Simultaneous aortic, jugular bulb, and right atrial pressures during cardiopulmonary resuscitation in humans. Insights into mechanisms [see comments]', *Circ,* 80: 361-68.

Plaisance, P., K. G. Lurie, E. Vicaut, F. Adnet, J. L. Petit, D. Epain, P. Ecollan, R. Gruat, P. Cavagna, J. Biens, and D. Payen. 1999. 'A comparison of standard cardiopulmonary resuscitation and active compression-decompression resuscitation for out-of-hospital cardiac arrest. French Active Compression-Decompression Cardiopulmonary Resuscitation Study Group', *N. Engl. J. Med,* 341: 569-75.

Ralston, S. H., C. F. Babbs, and M. J. Niebauer. 1982. 'Cardiopulmonary resuscitation with interposed abdominal compression in dogs', *Anesth. Analg,* 61: 645-51.

Segal, N. 2014. 'Intermittent positive-pressure ventilation, chest compression synchronized ventilation, bilevel ventilation, continuous chest compression, active compression decompression, and impedance threshold device-the complexity of ventilation during cardiopulmonary resuscitation', *Crit Care Med,* 42: 480-81.

Voorhees, W. D., M. J. Niebauer, and C. F. Babbs. 1983. 'Improved oxygen delivery during cardiopulmonary resuscitation with interposed abdominal compressions', *Ann. Emerg. Med,* 12: 128-35.

Wang, C. H., M. S. Tsai, W. T. Chang, C. H. Huang, M. H. Ma, W. J. Chen, C. C. Fang, S. C. Chen, and C. C. Lee. 2015. 'Active Compression-Decompression Resuscitation and Impedance Threshold Device for Out-of-Hospital Cardiac Arrest: A Systematic Review and Metaanalysis of Randomized Controlled Trials', *Crit Care Med,* 43: 889-96.

Weisfeldt, M. L., N. C. Chandra, and J. Tsitlik. 1981. 'Increased intrathoracic pressure—not direct heart compression-causes the rise in intrathoracic vascular pressures during CPR in dogs and pigs', *Crit Care. Med,* 9: 377-78.

Wolcke, B. B., D. K. Mauer, M. F. Schoefmann, H. Teichmann, T. A. Provo, K. H. Lindner, W. F. Dick, D. Aeppli, and K. G. Lurie. 2003. 'Comparison of standard cardiopulmonary resuscitation versus the combination of active compression-decompression cardiopulmonary resuscitation and an inspiratory impedance threshold device for out-of-hospital cardiac arrest', Circulation, 108: 2201-05.

Yeung, J., R. Meeks, D. Edelson, F. Gao, J. Soar, and G. D. Perkins. 2009. 'The use of CPR feedback/prompt devices during training and CPR performance: A systematic review', *Resuscitation,* 80: 743-51.

What is claimed is:

1. A method to increase the overall hemodynamic efficiency of external chest compressions performed during cardiopulmonary resuscitation on a patient comprising:

applying two or more chest compression-decompression cycles (CCDCs) to the patient suffering from cardiac arrest, wherein applying the two or more CCDCs to the patient includes applying a first set of CCDCs optimized to increase a cardiac output blood flow in the patient suffering from cardiac arrest and applying a second set of CCDCs optimized to increase a venous return blood flow in the patient suffering from cardiac arrest;

wherein the first set of CCDCs optimized for the cardiac output blood flow is performed alternately with the second set of CCDCs optimized for the venous return blood flow to enhance hemodynamic efficiency, wherein applying the two or more CCDCs results in return of spontaneous circulation for the patient suffering from cardiac arrest;

wherein optimizing the first set of CCDCs to increase the cardiac output blood flow includes the first set of CCDCs being different from standard CCDCs by greater compressive force, greater compressive speed, greater compression depth, more frequent compressions, prolonged compression phase relative to relaxation phase, and shorter relaxation phase, wherein optimizing the second set of CCDCs to increase the venous return blood flow includes the second set of CCDCs being different from standard CCDC's by adding active decompression, increased force of active decompression, increased speed of active decompression, lessened compressive force, lessened compressive speed, lessened compression depth, addition of impedance airway devices, and a prolonged decompression phase;

wherein standard CCDC's have a compression depth of 2 inches, a compression phase duration of 300 ms, a relaxation phase duration of 300 ms, and no active decompression.

2. The method according to claim 1, wherein a ratio of time intervals of the first set of CCDCs and the second set of CCDCs is not equal.

3. The method according to claim 1, wherein the first set of CCDCs optimized for the cardiac output blood flow comprises a first interval of multiple CCDCs and the second set of CCDCs optimized for the venous return blood flow comprises a second interval of multiple CCDCs.

4. The method according to claim 1, wherein an incremental transition occurs from the first set of CCDCs optimized for the cardiac output blood flow to the second set of CCDCs optimized for the venous return blood flow.

5. The method according to claim 1, wherein a speed of decompressions of at least one of the first set of CCDCs and the second set of CCDCs is adjusted based on a biomarker measurement obtained from the patient.

6. The method according to claim 1, wherein a pattern of transition from the first set of CCDCs optimized for the cardiac output blood flow to the second set of CCDCs optimized for the venous return blood flow includes a third set of CCDCs that transition from the first set to the second set, wherein the third set is adjusted based on a biomarker measurement obtained from the patient.

7. The method according to claim 2, the ratio of the first set to the second set is 3 to 2.

8. The method according to claim 1, wherein CCDCs, or their respective phases, are further enhanced by phasic manipulation of the abdomen.

9. The method according to claim 1, wherein CCDCs, or their respective phases, are further enhanced by phasic alteration in ventilation pattern or pressures.

10. The method according to claim 1, wherein the CCDCs, or their respective phases, are further enhanced by phasic alteration in the patient's body position or a portion of the patient's body chosen from a list that includes the head, neck, chest, abdomen, arms or legs.

11. A method of forcing circulation of blood out from a patient's heart and back in to the patient's heart during cardiac arrest before return of spontaneous circulation (ROSC), the method comprising:

alternating between at least two different types of chest compression-decompression cycles (CCDCs), wherein alternating between at least two different types of CCDCs comprises:

applying an outflow set of CCDCs to the patient, wherein the outflow set of CCDCs force blood out of the heart and out to bodily extremities; and applying a return flow set of CCDCs to the patient wherein the return flow set of CCDCs pull blood back to the heart from the veins;

wherein the outflow set of CCDCs to force blood out of the heart and out to bodily extremities includes the outflow set of CCDCs being different from the return flow set of CCDCs by greater compressive speed, greater compression depth, decreased force of active decompressions, decreased speed of active decompressions, and wherein the return flow set of CCDCs to pull blood back into the heart from the veins includes the return flow set of CCDCs being different from the outflow set of CCDCs by increased speed of active decompression, increased force of active decompression, lessened compressive speed, and lessened compression depth.

12. A method of forcing circulation of blood out from a patient's heart and back in to the patient's heart during cardiac arrest comprising:

alternating between at least two different types of chest compression-decompression cycles (CCDCs), wherein alternating between at least two different types of CCDCs comprises:

applying a first set of CCDCs to the patient that increase pressure in an arterial compartment of the patient; and applying a second set of CCDCs to the patient that decrease pressure in a venous compartment of the patient;

wherein the first set of CCDCs that increase pressure in the arterial compartment includes the first set of CCDCs being different from the second set of CCDCs by greater compressive speed, greater compressive force, greater compression depth, more frequent compressions, prolonged compression phase relative to relaxation phase, addition of thoracic constriction, decreased force of active decompression, decreased speed of active decompressions, and shortened decompressive phase, and wherein the second set of that decrease pressure in the venous compartment includes the second set of CCDCs being different from the first set of CCDCs by adding active decompression, increased speed of active decompression, increased force of active decompression, lessened compressive force, lessened compressive speed, and lessened compression depth, addition of impedance airway devices, and a prolonged decompression phase.

13. The method according to claim 12, wherein alternating between the first set of CCDCs that increase pressure in the arterial compartment and the second set of CCDCs that decrease pressure in the venous compartment further comprises decreasing the pressure of the venous compartment below the pressure of the arterial compartment, thereby facilitating the flow of blood out to the extremities and back to the heart.

14. The method according to claim 12, wherein applying the second set of CCDCs that decrease pressure in the venous compartment of the patient further comprises overcoming the presence of inertial resistance to flow so that blood is pulled from the surrounding tissues back towards the heart.

15. The method according to claim 12, wherein alternating between the first set of CCDCs that increase the pressure in the arterial compartment and the second set of CCDCs that decrease pressure in the venous compartment further comprises increasing blood flow to result in return of spontaneous circulation (ROSC) in patients with no native circulation.

* * * * *